United States Patent [19]

Vochatzer

[11] Patent Number: 4,709,520

[45] Date of Patent: Dec. 1, 1987

[54] STAIR BRACKETS AND STAIR STRUCTURE

[76] Inventor: Richard L. Vochatzer, 232 N. 31st St., Kansas City, Kans. 66102

[21] Appl. No.: 889,773

[22] Filed: Jul. 28, 1986

[51] Int. Cl.[4] ..... E04F 11/00

[52] U.S. Cl. ..... 52/191; 182/93; 182/220; 52/182

[58] Field of Search ..... 52/179, 182, 188, 190, 52/191; 248/300; 182/93, 220

[56] References Cited

U.S. PATENT DOCUMENTS

| | | | |
|---|---|---|---|
| 2,724,466 | 11/1955 | Phillips | 52/191 |
| 2,879,556 | 3/1959 | Lyons | 52/191 |
| 2,936,863 | 5/1960 | Holzer | 52/191 |
| 3,021,928 | 2/1962 | Blair | 52/191 |
| 3,289,367 | 12/1966 | MacIntosh | 52/191 |
| 3,331,579 | 7/1967 | Petersen | 249/14 |
| 3,556,251 | 1/1971 | Whitehead | 182/93 |
| 3,888,058 | 6/1975 | Ahrens | 52/191 |
| 4,015,687 | 4/1977 | Dean | 182/220 |
| 4,034,525 | 7/1977 | Yokomori | 52/188 |
| 4,464,870 | 8/1984 | Crepeau | 52/188 |
| 4,593,503 | 6/1986 | Koslowski | 52/188 |

FOREIGN PATENT DOCUMENTS

| | | | |
|---|---|---|---|
| 844261 | 6/1970 | Canada | 52/183 |
| 232802 | 3/1911 | Fed. Rep. of Germany | 52/188 |
| 1370733 | 12/1964 | France | 52/188 |
| 405044 | 2/1934 | United Kingdom | 52/188 |
| 741539 | 12/1955 | United Kingdom | 52/188 |
| 2030192A | 4/1980 | United Kingdom | 52/188 |

*Primary Examiner*—John E. Murtagh
*Assistant Examiner*—Andrew Joseph Rudy
*Attorney, Agent, or Firm*—Litman, McMahon & Brown

[57] ABSTRACT

Stair brackets are provided for mounting on stringers and supporting treads in stair structures extending between upper and lower floors. Lower brackets interconnect the lower floor, lower ends of the stringers and the lowermost tread. Angle brackets are mounted on the stringer between the lower bracket and the upper floor. Hangers secure the stringer upper ends to the upper floor.

2 Claims, 6 Drawing Figures

STAIR BRACKETS AND STAIR STRUCTURE

BACKGROUND OF THE INVENTION

1. Field of the Invention

The present invention relates generally to stair structures and in particular to brackets for constructing stair stringer assemblies.

2. Description of the Prior Art

Various types of stair structures are well known in the construction industry and generally include a plurality of horizontal treads supported at regularly-spaced horizontal and vertical intervals. Vertical panels referred to as risers are sometimes placed between adjacent pairs of treads. The treads and risers may be supported by inclined beams, which are commonly referred to as stringers. In a stair structure comprising a single, straight flight of stairs extending between the floors of a building, the stringers may span a considerable distance and support a substantial load.

In residential wood-frame construction, the stringers are often formed from 2×12's, i.e. lumber with a nominal thickness of 2 inches and a nominal width of 12 inches respectively. Typically, the stringers are notched to provide a series of stair-stepped, horizontal edges for supporting the treads. However, a problem with this type of construction is that the notches significantly weaken the stringers. For example, many residential building codes now require a minimum of 11 inches for the tread depth (measured front-to-back) and a maximum of 7 inches for the riser height. A 2×12 stringer notched to meet these minimums is reduced to a minimum width of about 5 to 6 inches, or about one-half of its original width. Thus, conventional, notched stringers tend to be relatively weak and subject to deflection when loaded. Since building codes generally require that stairs be capable of supporting certain minimum loads without deflecting more than a given amount, conventional stringers must often be supported in midspan.

Another problem with conventional stringers formed in this manner is that the 2×12's are relatively expensive compared to other sizes of structural lumber. One reason is that much larger trees are required to produce 2×12's than, for example, 2×6's, whereby the former tend to command a premium price per board foot. Since a substantial amount of the structural strength of a 2×12 is lost when it is notched for use as a stringer, conventional stringer construction practice represents a relatively inefficient use of timber resources and a relatively costly method of constructing stairs.

The Phillips U.S. Pat. No. 2,724,466 shows a stair construction comprising metal brackets bolted together with treads and risers fastened thereto. Although this arrangement avoids some of the aforementioned shortcomings of conventional stairs with notched stringers, it is relatively complex and is not particularly well-suited for spanning relatively long distances since it lacks a structural member functioning as a beam.

Step brackets for mounting on un-notched stringers are shown in the Dean U.S. Pat. No. 4,015,687. The brackets are attached to the top edges of stringers and to the bottom faces of treads. However, they offer little resistance to lateral forces and they might be difficult to utilize in certain stairs because of the conditions encountered at the top and the bottom.

Another stairway with un-notched stringers is shown in the Crepeau U.S. Pat. No. 4,464,870 wherein the treads are notched to receive the risers and both are toenailed to the top edges of the stringers. However, this construction requires relatively precise joinery of the treads and risers and also requires carefully calculating the dimensions of each in order to have the treads evenly spaced and level.

Heretofore, there have not been available brackets for stair structures with the advantages and features of the present invention.

SUMMARY OF THE INVENTION

In the practice of the present invention, brackets are provided for mounting treads on stringers in a stair structure extending between upper and lower floors. A lower bracket interconnects a lower end of the stringer, the lower floor and the lowermost tread. A plurality of regularly-spaced angle brackets are mounted on each stringer for supporting the remaining treads. Each bracket includes a faceplate and front and back legs which offer resistance to compressive and lateral forces. The brackets are secured to the treads with mechanical fasteners and include locating flanges for proper positioning. In a first modified embodiment of the present invention, the locating flanges include slotted receivers and are placed on the stringer in overlaping configurations so that each fastener can secure their respective ends of two brackets and provide substantial lateral rigidity. The upper ends of the stringers are secured to the upper floor by hangers.

OBJECTS OF THE INVENTION

The objects of the present invention are: to provide brackets for stair structures; to provide such brackets which are relatively strong and produce a relatively rigid stair structure; to provide such brackets which may be used in constructing a stair structure with an un-notched stringer; to provide such stair brackets which permit the construction of stair structures with relatively narrow wood stringers; to provide such stair brackets which eliminate some of the wasted wood associated with previous methods of constructing stair structures; to provide such stair brackets which facilitate fast and economical stair construction; to provide such stair brackets which are efficient in operation, economical to manufacture, capable of a long operating life and particularly well adapted for the proposed usage thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figures 1, 2, 3:
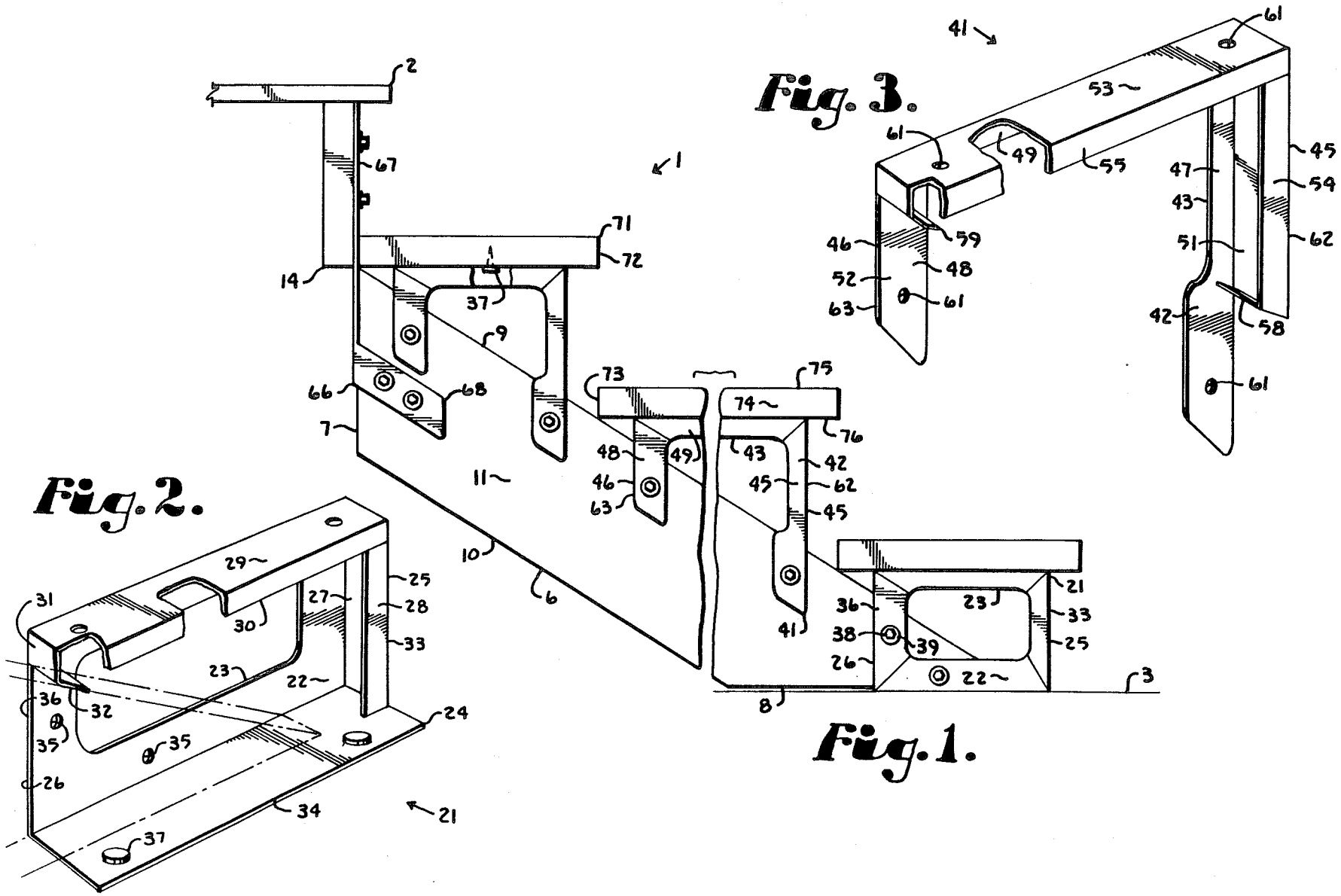
FIG. 1 is a fragmentary, side elevational view of a stair structure with brackets embodying the present invention.
FIG. 2 is a perspective view of a lower bracket for mounting on the lower end of a stair stringer.
FIG. 3 is a perspective view of an angle bracket for mounting between the ends of the stair stringer.
Figure 4:
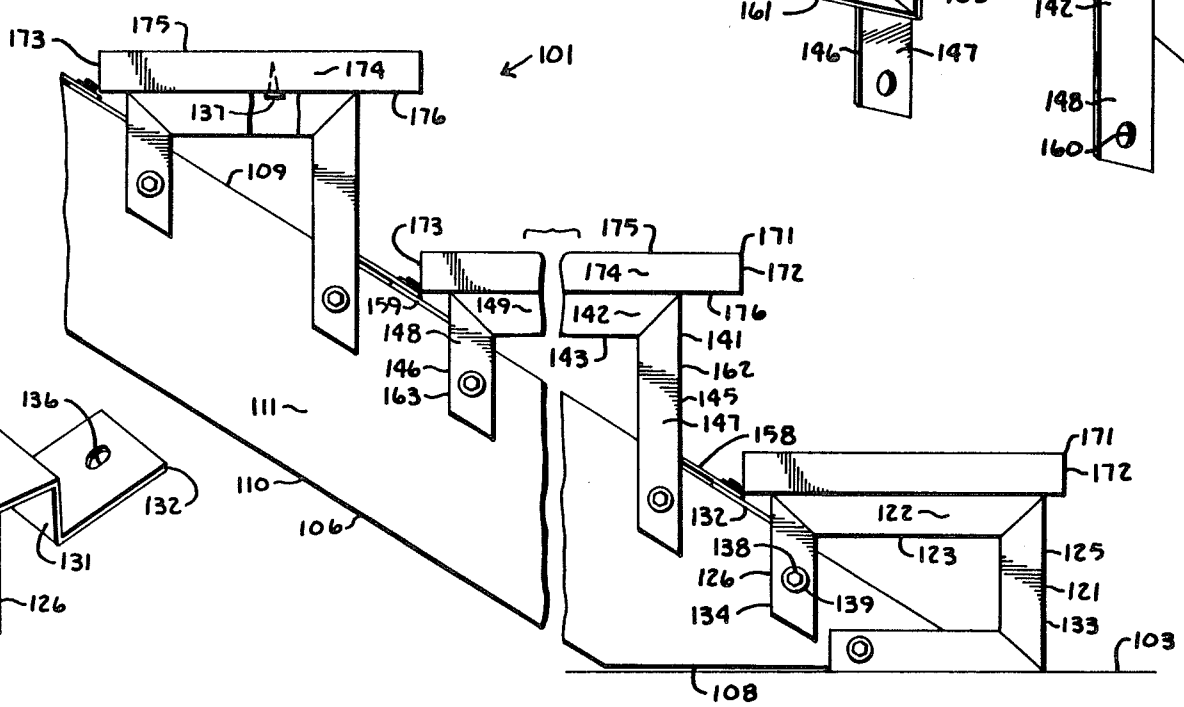
FIG. 4 is a fragmentary, side elevational view of a stair structure with brackets comprising a first modified embodiment of the present invention.

The terms "front" and "back" and similar terms refer to directional orientations to the right and left respectively of the stair structures as oriented in FIGS. 1 and 4. The terms "inner" and "outer" and similar terms refer to directional orientations in relation to the longitudinal centerline of the stair structures.

Referring to the drawings in more detail, the reference numeral 1 generally designates a stair structure extending between upper and lower floors 2, 3. The stair structure 1 includes a pair of spaced-apart, parallel stringers 6 with upper and lower ends 7, 8; upper and lower edges 9, 10; an inside face (not shown); and an outside face 11.

Without limitation on the generality of useful applications for the present invention, the stair structure 1 is of the type that might be used in residential, woodframe construction. Consistent with the construction techniques employed therein, the stringers 6 comprise common wood structural members, e.g. 2×6's with actual thickness and width dimensions of approximately 1 ½ inches by 5 ½ inches respectively. However, various types and sizes of structural members selected for their desired characteristics of strength, weight, etc. can be used for the stringers 6. Furthermore, three or more stringers 6 can be used in constructing a stair structure, rather than the pair described herein.

As shown in FIG. 1, the stringer upper and lower ends 7, 8 are cut at angles so that their orientations are substantially vertical and horizontal respectively. The stringer upper end 7 is mounted on a floor joist 14 of the upper floor 2 and the stringer lower end 8 is mounted or rests on the lower floor 3.

A lower bracket 21 with front and back ends 25, 26 is mounted on the stringer lower end 8 and rests on the lower floor 3. The lower bracket 21 comprises a faceplate 22 with a central opening 23, a baseplate 24 forming a right dihedral angle with the faceplate 22, a front strip 27 with a return 28 and a top strip 29 with a return 30. The baseplate 24, the front strip 27 and the top strip 29 all form right dihedral angles with the faceplate 22. The returns 28, 30 extend parallel to the faceplate 22. A back strip 31 is connected to the faceplate 22 and the top strip 29. A locating flange 32 extends downwardly and forwardly from the back strip 31 at an angular orientation corresponding to that of the stringer 6. The locating flange 32 is attached to the faceplate 22. The baseplate 24 terminates at an inner margin 34 located inwardly from the returns 28, 32. A pair of receivers 35 extend through the faceplate 22 in proximity to its back end 26 and the baseplate 24. The faceplate 22 and the front and back strips 27, 31 form front and back legs 33, 36.

The lower bracket baseplate 24 is fastened to the lower floor 3 by nails 37 and to the stringer 6 by screws 38 placed in the receivers 35 and mounting washers 39 whereby the faceplate 22 is placed against the stringer outside face 11. The locating flange 32 at the lower bracket back end 26 can be used to properly position the lower bracket 21 on the stringer lower end 8.

Angle brackets 41 are provided for mounting on the stringer 6 between its ends 7, 8 and include outside faceplates 42 with openings 43 and front and back ends 45, 46. The faceplate 42 comprises front and back portions 47, 48 which depend downwardly from a faceplate top portion 49. Front, back and top strips 51, 52 and 53 project inwardly from the faceplate 42 and form respective right dihedral angles therewith. Front and top returns 54, 55 extend from the front and top strips 51, 53 respectively in parallel, spaced relation to the faceplate front and top portions 47, 49 respectively. Front and back locating flanges 58, 59 extend from the lower ends of the front and back strips 51, 52 at angular orientations corresponding to the angle of the stringer 6 for mounting against its upper edge 9.

The faceplate front and back portions 47, 48 each includes a receiver 61 positioned below a respective locating flange 58, 59 for receiving a hex-head mounting screw 38 for mounting to the stringer 6. Each angle bracket 41 includes a front leg 42 comprising a respective faceplate front portion 47, a front strip 51, a front return 54 and a front locating flange 58. Each angle bracket 41 also includes a respective back leg 63 comprising a faceplate back portion 48, a back strip 52 and a back locating flange 59.

The stringer upper end 7 is mounted on the floor joist 14 by a hanger 66 comprising joist and stringer sections 67, 68 attached to the floor joist 14 and the stringer 6 respectively by hex-head screws 38 and washers 39. Treads 71 with front and back edges 72, 73; opposite ends 74 and upper and lower faces 75, 76 are mounted on the brackets 21, 41 by driving nails 37 through top strip receivers 78 and into the treads 71 from their lower faces 76.

In constructing the stair structure 1, the stringers 6 are cut to an appropriate length with their ends 7, 8 angled to fit flush against the joist 14 and the lower floor 3 respectively. The permissible steepness of the stair structure 1 is dictated by building codes in many locations. For example, some residential building codes permit a maximum steepness of seven inches of vertical rise for eleven inches of horizontal run, which dimensions generally correspond to the vertical and horizontal spacing of the treads 71. A stair structure constructed according to these criteria would have an angle of inclination of approximately 32.5° from the horizontal.

The spacing of the treads 71 is then determined, e.g. seven inches (rise) between their respective upper faces 75 and eleven inches (run) between their respective front edges 72. The upper face 75 of the uppermost and lowermost treads 71 would likewise be seven inches from the finished levels of the upper and lower floors 2, 3 in the example given so that a person negotiating the stair structure 1 could take relatively consistent steps throughout the entire length thereof.

Preferably, the stringers 6 are marked at appropriate increments to indicate the locations of the brackets 21, 41 so that the treads 71 will be evenly spaced. The stringers 6 are installed with the hangers 66 and the lower brackets 21. If desired, the stringer lower ends 8 can be fastened to the lower floor 3. Two or more stringers 6 are generally employed. As previously mentioned, the brackets 21, 41 are attached to the tread lower faces 76 by mechanical fasteners, such as the nails 37, to form bracket and tread subassemblies. The brackets 41 are placed on the stringers 6 at the appropriate locations. As shown in FIG. 1, the tread back edges 73 may engage the stringer upper edges 9. The hex-head screws 38 are used for attaching the brackets 21, 41 to the stringers 6. The bracket locating flanges 32, 58, 59 assist in properly locating the respective brackets 21, 41 on the stringers 6.

The resulting stair structure 1 is quite strong and capable of supporting the loads that would normally be encountered in residential use. For example, the front and back bracket legs 62, 63 comprise two and three panels respectively and are capable of resisting substantial compression forces and lateral bending forces. Furthermore, the bracket locating flanges 32, 58 and 59 cooperate with the stringer upper edge 9 to resist lateral bending of the brackets 21, 41 in a direction transverse to the stair structure 1. Thus, the treads 71 will feel relatively solid to persons walking on them. Furthermore, by employing the brackets 21, 41, the stringers 6 do not have to be notched so that they are better able to resist bending loads. Additional mechanical fasteners such as nails 37 and screws 38 may be employed with the brackets 21, 41. For example, the locating flanges 32, 58, 59 could be attached to the stringer upper edges 9.

Figure 6:
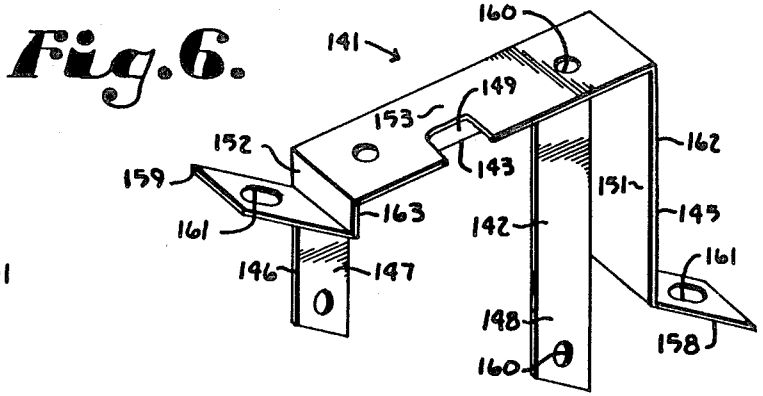
FIG. 6 is a perspective view of an angle bracket for mounting between the ends of the stair stringer.
Figure 5:
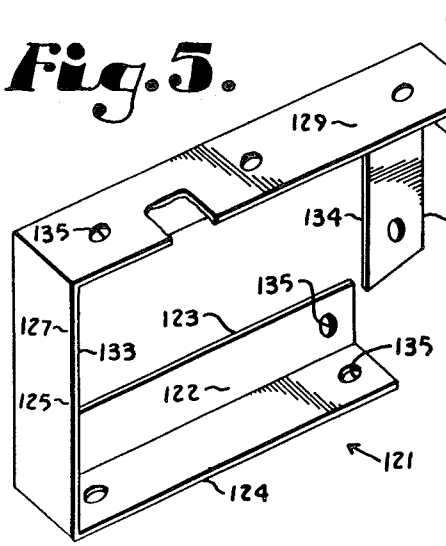
FIG. 5 is a perspective view of a lower bracket for mounting on the lower end of a stair stringer.

A stair structure 101 with lower and angle brackets 121, 141 comprising first modified embodiments of the present invention is shown in FIGS. 4–6. The stair structure 101 extends from a lower floor 103 to an upper floor (not shown) and includes a pair of stringers 106 with lower ends 108, upper and lower edges 109, 110 and outside faces 111.

Each lower bracket 121 includes a faceplate 122 with an opening 123 and front and back ends 125, 126. A baseplate 124 extends laterally from the faceplate 122 and forms a right dihedral angle therewith. Front, top and back strips 27, 29, 31 also extend from the faceplate 22 and form right dihedral angles therewith. A locating flange 132 projects rearwardly and upwardly from the lower end of the back strip 131 at an angle corresponding to the angle of inclination from the horizontal of the stringer 6.

Receivers 135 are provided in the faceplate 122, the baseplate 124 and the top strip 129. A slotted receiver 136 extends through the locating flange 132 and extends longitudinally with the stringer 106. The faceplate 122 and the front and back strips 127, 131 form front and back legs 133, 134 respectively.

The lower brackets 121 are mounted on the stringer 6 with hex-head screws 138 and washers 139. Each angle bracket 141 includes front and back ends 145, 146 and a faceplate 142 with an opening 143. The faceplate 147 includes front, back and top portions 147, 148 and 149. Front, back and top strips 151, 152 and 153 extend from the faceplate front, back and top portions 147, 148 and 149 respectively and form right dihedral angles therewith. Front and back locating flanges 158, 159 extend from the front and back strips 151, 152 respectively at angles corresponding to the angle of inclination of the stair stringers 106. The front and back faceplate portions 147, 148 include receivers 160 adjacent to their lower ends. The locating flanges 158, 159 include slotted receivers 161 which are longitudinally aligned with the stringers 106. Front and back legs 162, 163 are formed by the front and back faceplate portions 147, 148 and the front and back strips 151, 152 respectively.

Treads 171 including front and back edges 172, 173; opposite ends 174; and upper and lower faces 175, 176 are mounted on the bracket top strips 129, 153 by suitable mechanical fasteners such as nails 137.

In assembling the stair structure 101, the spacing of the brackets 121, 141 is determined by a procedure similar to that described above in connection with the stair structure 1. Respective pairs of brackets 121, 141 are mounted on the lower faces 176 of the treads 171. The bracket and tread subassemblies are placed at appropriate intervals on the stringers 106 and secured by mechanical fasteners, for example, hex-head screws 138 and washers 139, which are received in aligned slotted receivers 136, 161. The front locating flange 158 of each angle bracket 141 overlies the locating flange 132 or 159 of the bracket 121 or 141 positioned directly below and in front of it as shown in FIG. 4. The slotted receivers 136, 161 allow the brackets 121, 141 to be shifted longitudinally on the stringer 106 to achieve proper spacing. When properly positioned, the brackets 121, 141 are secured in place by mechanical fasteners comprising screws 138 received in the receivers 160 and washers 139. The screws 138 extending through the locating flanges 132, 158 and 159 provide for cooperation between the respective brackets 121, 141 and the stringers 106 so that a relatively rigid stair structure 101 is provided. In particular, lateral rigidity is enhanced by this arrangement. The lower bracket 121 may be secured to the lower floor 103, the stringer lower end 108 or both by suitable mechanical fasteners (not shown) in the receivers 160 extending through its baseplate 124.

The brackets 21, 41, 121 and 141 may be formed from a variety of materials, although stamped sheet metal would provide for relatively simple construction. Sheet metal bracket blanks could be folded into their desired configurations and the various sections thereof secured in place by welding, riveting, bolting, etc.

Likewise, a variety of mechanical fasteners could be used for assembling the stair structures 1 and 101. For example, nails, screws, bolts, etc. could be employed where appropriate.

It is to be understood that while certain forms of the present invention have been illustrated and described herein, it is not to be limited to the specific forms or arrangement of parts described and shown.

What is claimed and desired to be secured by Letters Patent is as follows:

1. A stair structure extending between upper and lower floors, which comprises:

(a) a parallel, spaced pair of stringers, each including:
  (1) upper and lower ends;
  (2) upper and lower edges; and
  (3) inside and outside faces;

(b) a discrete pair of lower brackets each including:
  (1) a vertical faceplate;
  (2) a horizontal baseplate placed between a respective stringer lower end and said lower floor;
  (3) front and back ends;
  (4) front and back strips extending from said faceplate at said front and back ends respectively;
  (5) a top strip extending from said faceplate in spaced relation over said stringer upper edge; and
  (6) a locating flange extending forwardly from said back strip and positioned against said stringer upper edge;

(c) a discrete pair of angle brackets each including:

(1) a vertical faceplate with an opening defining front, back and top portions;
(2) front and back ends;
(3) front, back and top strips extending from said faceplate front, back and top portions respectively, said top strip being positioned in spaced relation over a respective stringer upper edge; and
(4) front and back locating flanges extending downwardly and forwardly from said front and back strips respectively and engaging said stringer upper edge;

(d) a lower tread mounted on the top strips of said pair of lower brackets and extending therebetween;
(e) an upper tread mounted on said pair of angle brackets and extending therebetween;
(f) a pair of discrete stringer hangers each mounted on a respective stringer upper end and attached to said upper floor, each said stringer hanger including a joist section attached to a joist of said upper floor and a stringer section attached to a respective stringer upper end; and
(g) fastening means fastening said bracket faceplates to respective stringer faces.

2. A stair structure extending between upper and lower floors, which comprises:
(a) a parallel, spaced pair of stringers, each including:
(1) upper and lower ends;
(2) upper and lower edges; and
(3) inside and outside faces;

(b) a pair of discrete lower brackets each including:
(1) a vertical faceplate;
(2) a horizontal baseplate placed between a respective stringer lower end and said lower floor;
(3) front and back ends;
(4) front and back strips extending from said faceplate at said front and back ends respectively;
(5) a top strip extending from said faceplate in spaced relation over said stringer upper edge; and
(6) a locating flange extending rearwardly from said back strip and having an elongated receiver aligned with said stringer;

(c) a pair of discrete angle brackets each including:
(1) a vertical faceplate with an opening defining front, back and top portions;
(2) front and back ends;
(3) front, back and top strips extending from said faceplate front, back and top portions respectively, said top strip being positioned in spaced relation over a respective stringer upper edge; and
(4) front and back locating flanges extending forwardly and rearwardly from said front and back strips respectively and including elongated receivers aligned with said stringers;

(d) a lower tread mounted on the top strips of said pair of lower brackets and extending therebetween;
(e) an upper tread mounted on the top strips of said pair of angle brackets and extending therebetween;
(f) a pair of discrete stringer hangers each mounted on a respective stringer upper end and attached to said upper floor, each said stringer hanger including a joist section attached to a joist of said upper floor and a stringer section attached to said stringer upper end;
(g) fastening means fastening each said bracket faceplate to a respective stringer face;
(h) said lower bracket locating flanges and said angle bracket front locating flanges being positioned in overlying relation with respective elongated receivers at least partly aligned; and
(i) a plurality of mechanical fasteners each extending through respective elongated receivers of said overlying locating flanges and into said stringers for mounting said brackets on said stringers.

* * * * *